US006073782A

United States Patent [19]

Ascik

[11] Patent Number: 6,073,782

[45] Date of Patent: Jun. 13, 2000

[54] EYEGLASS AND ACCESSORY DISPLAY PANELS AND STAND

[75] Inventor: Mark A. Ascik, Ormond Beach, Fla.

[73] Assignee: Capo, Inc., Ormond Beach, Fla.

[21] Appl. No.: 09/394,493

[22] Filed: Sep. 13, 1999

[51] Int. Cl.[7] ..... A47F 5/00

[52] U.S. Cl. ..... 211/85.1; 211/189; 206/767; 206/774; 206/730

[58] Field of Search ..... 211/85.2, 85.1, 211/85.3, 189, 163; 248/174; 206/767, 774, 730

[56] References Cited

U.S. PATENT DOCUMENTS

| | | | |
|---|---|---|---|
| D. 328,398 | 8/1992 | Benedetto | 211/57.1 X |
| 3,756,421 | 9/1973 | Wilkins | 211/163 |
| 3,836,007 | 9/1974 | Rosenwein | 211/85.1 |
| 3,891,092 | 6/1975 | Sunette et al. | 211/163 X |
| 4,157,760 | 6/1979 | Wilson . | |
| 4,211,331 | 7/1980 | Salmon et al. | 211/85.1 |
| 4,609,975 | 9/1986 | Badolato . | |
| 4,850,658 | 7/1989 | Sandor . | |
| 4,940,297 | 7/1990 | Borgen . | |
| 5,016,761 | 5/1991 | Stoddard . | |
| 5,257,703 | 11/1993 | Ascik . | |
| 5,347,734 | 9/1994 | Howell et al. | 211/163 X |
| 5,383,722 | 1/1995 | Chen . | |
| 5,507,237 | 4/1996 | Barrow . | |
| 5,540,335 | 7/1996 | Friedman | 206/767 X |
| 5,794,782 | 8/1998 | Ascik | 206/730 X |
| 5,853,090 | 12/1998 | Brozak, Jr. . | |
| 5,899,343 | 5/1999 | Franklin . | |
| 5,931,319 | 8/1999 | Murphy | 211/85.2 |

*Primary Examiner*—Robert W Gibson, Jr.
*Attorney, Agent, or Firm*—Hopgood, Calimafde, Kalil & Judlowe, LLP

[57] ABSTRACT

A merchandise display having a number of sides is provided in each side with a recess for removably accepting a panel having two faces, one for displaying goods and the other having a graphic. The panel can be removed and the same or different goods, preferably related goods, can be displayed in the recess. The panel can be reinserted into the recess with the graphic facing outwards towards the consumer. When the merchandise displayed on the panel is sufficiently depleted, the remaining merchandise can be moved to restock another panel, and the panel can be removed and the recess stocked with related merchandise. When the related merchandise is depleted, the panel can be replaced with the graphic facing outwards rather than the merchandise display face facing outwards towards the consumer. Using this combination of merchandise displayed on the panel, in the recess, and a non-merchandise displaying graphic, the retailer can manipulate the panels and recesses to provide a display that appears at all times to be well-stocked and inviting to the consumer. As such, for example, when half of the merchandise on the panels and half of the merchandise in the recesses is sold, the retailer can rearrange the display so that the areas for displaying merchandise accomodate the remaining merchandise without significant areas barren of merchandise.

6 Claims, 2 Drawing Sheets

EYEGLASS AND ACCESSORY DISPLAY PANELS AND STAND

BACKGROUND OF THE INVENTION

1. Field of the Invention

This invention relates to a display apparatus for eyeglasses and other eyewear or accessories that can be changed as the goods are sold so that the display appears to be well-stocked.

2. The State of the Art

There are various devices available for the retail display of (eye)glasses and related accessories such as cords, repair kits, and the like. These devices often include a case rotatably supported on a center post, where the case is comprised of, or accepts, panels on which eyeglasses (e.g., sunglasses) can be mounted for display.

One problem with such display cases at the retail level is that as more goods are sold the case tends to look less well-stocked. This is because such cases are typically shipped from the supplier fully stocked with glasses and the retailer does not have a separate inventory of glasses to refill the display case. A partially-filled (or partially-emptied) display does not have the aesthetic presentation of a full (or mostly filled) display.

One method for partially alleviating this problem is to provide a display that includes a separate inventory. Ascik, in U.S. Pat. No. 5,794,782, Surrette et al. in U.S. Pat. No. 3,981,092, and Brozak, Jr., in U.S. Pat. No. 5,853,090, all disclose a display case having hidden or stored stocked display panels, so the device essentially includes an inventory of stocked panels that can be used to replace the panels from which the glasses have already been sold. Another type of apparatus is disclosed by Ascik et al., in U.S. Pat. No. 5,257,703, in which the height of the display can be changed as goods are sold, thus giving the appearance that the display is always essentially full because the display area is changed. The disclosures of all of these patents are incorporated herein by reference.

SUMMARY OF THE INVENTION

In light of the foregoing, the primary object of this invention is to provide an eyeglass display that can be modified to display eyeglass accessories and/or graphic panels so that the display has the appearance of being well-stocked at all times.

As such, in a preferred embodiment this invention provides an eyeglass display comprising a frame or case, preferably rotatably mounted, having panel recesses for accepting display panels for displaying eyeglasses, the recesses having means for mounting additional displayed goods, and display panels having a displayable stock of glasses on a front portion and a back portion with a graphic.

DETAILED DESCRIPTION OF SPECIFIC EMBODIMENTS

Figure 1:
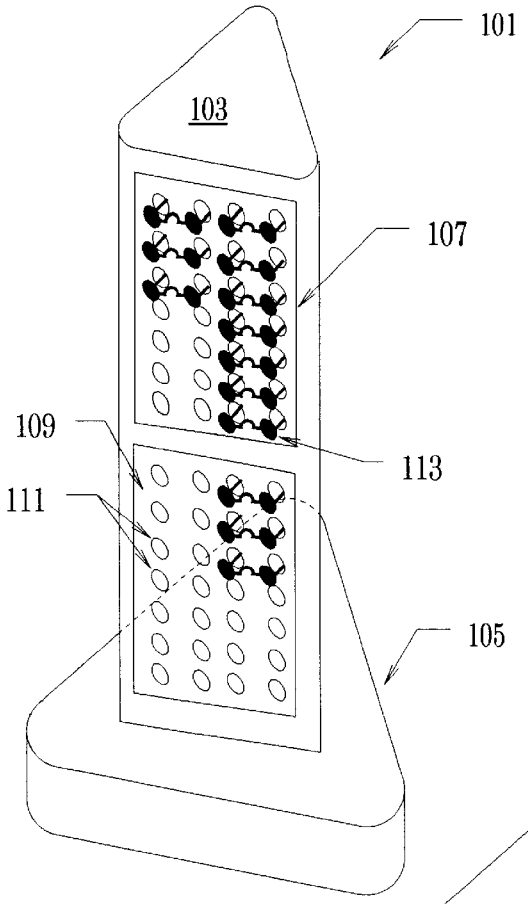
FIG. 1 is an idealized perspective view of the display according to this invention with two panels on a single face of the display frame shown for displaying glasses.
Figure 2:
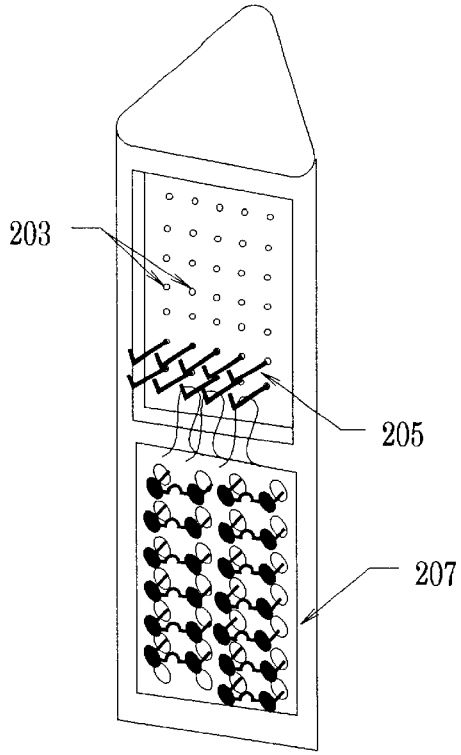
FIG. 2 is an idealized perspective view of the display according to this invention with one panel shown for displaying glasses and a panel recess with pegs for diplaying accessory merchandise.

The display apparatus of this invention generally comprises, with reference to FIG. 1, a frame 101 having a top portion 103 and a base 105. The frame preferably has a right polygonal geometry (triangular being shown) and preferably is rotatably mounted on a central, internal pole (not shown) so that is can be turned by the consumer perusing the display; such rotatable displays are shown in various of the above-mentioned patents. The frame includes a number of panel recesses 201 as shown in FIG. 2, in which a display panel 107 can be retained, preferably releasably. The panel is generally rectilinear in preferred embodiments, but the recess and panel can both be of the same two-dimensional geometric shape (e.g., triangular, trapezoidal, pentagonal, etc.). In the preferred embodiment of a rectilinear panel, the predominant panel surfaces are a front surface 109 for displaying merchandise (glasses) and a rear, opposing surface 301 having a graphical image. The frame is preferably made of cardboard or the like material, and the top and base are preferably plastic, although the entire apparatus or portions thereof can be made from one or more of cardboard, plastic, wood, and the like. The front surface of the panel has a series of pairs of holes 111 or other means (e.g., pegs) for holding and displaying eyeglasses 113.

When first shipped from the manufacturer, supplier, or wholesaler, preferably the front surface of each panel is stocked with glasses for display. As a panel is depleted of its merchandise, the retailer can move merchandise on other panels to that panel so that the panel appears to be well-stocked at all times. Eventually, however, such as for the two panels in FIG. 1 shown on one face of the frame, there will not be sufficient merchandise to make both panels appear to be well-stocked. At this point, the merchandise can be moved to one of the panels, such as the bottom panel shown in FIG. 2. Thus, the bottom panel in FIG. 2 will be, or will appear to be, well-stocked. The upper panel is removed revealing the recess.

The recess has, or accepts, a device or a plurality of devices for displaying additional, different merchandise; for eyeglass displays, this merchandise is preferably related goods such as cords, eyeglass repair kits, jewelry, hair accessories, and the like, and combinations thereof. In the embodiment shown in FIG. 2, the recess has a number of small holes 203 for accepting pegs 205 on which the related merchandise can be hung, such as by a drop tag or other means. Accordingly, even though the glasses may not be sufficient to fill both panels on one of the frame faces, the merchandise on a single panel 207 and displayed in the recess will give that face of the frame the appearance of being well-stocked.

Figure 3:
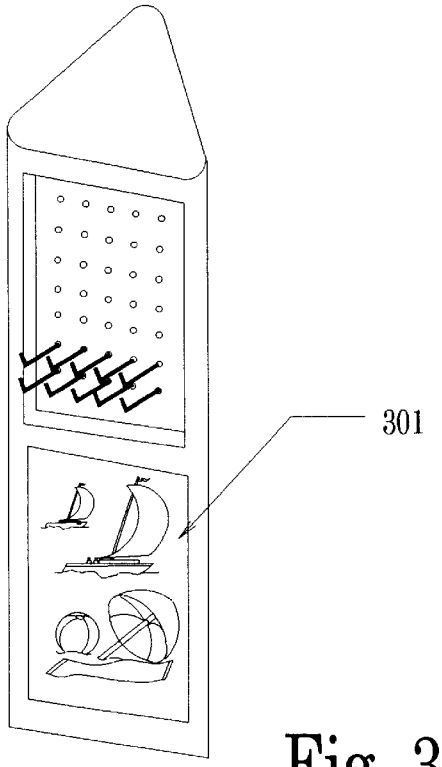
FIG. 3 is an idealized perspective view of the display according to this invention with a panel recess with pegs for diplaying drop cards and another panel shown displaying a graphic.
Figure 4:
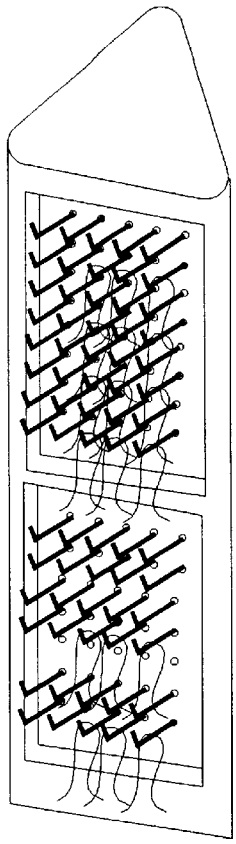
FIG. 4 is an idealized perspective view of the display according to this invention with two panels on a single face of a display frame shown with pegs for displaying accessory merchandise.
Figure 5:
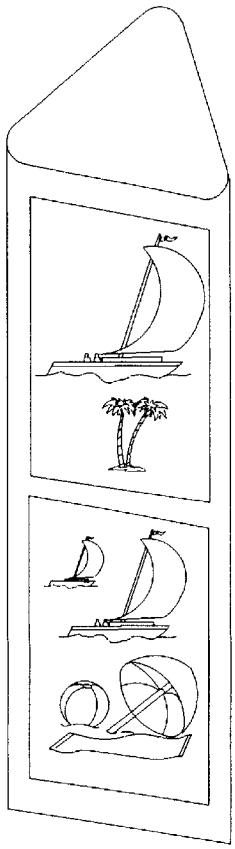
FIG. 5. is an idealized perspective view of the display according to this invention with two panels on a single face of a display frame shown with graphic panels.

Again, more merchandise will be sold, and eventually the merchandise displayed on the panel or in the recess will be depleted. At this point, the panel can be reversed to display a graphic as shown in FIG. 3 and inserted into the same recess; the related merchandise is still displayed in the other recess without a panel. With the graphic displayed, like the Ascik et al. patent, the effective display area is reduced, again giving the appearance that the display is well-stocked (because of the reduced display area). Alternatively, as shown in FIG. 4, both panels on one face can be removed and the accessory merchandise displayed on hooks in both recesses. When even this merchandise is sold, the panel can be replaced in the recess and reversed to reveal a graphic so that it appears that that the entire face of the frame is not intended for displaying merchandise, as shown in FIG. 5. Thus, again, the impression that the display is almost empty is avoided and the consumer is presented with a display which may have less merchandise than before, but the visible or viewable display area is essentially stocked with merchandise.

It should be understood that the additional merchandise need not be as related as glasses and cords and, for example, can be sunglasses and sunscreen, or toys, or jewelry, or hand-held games.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A merchandise display, comprising:

a right polygonal frame having a plurality of faces;

at least one of said faces having at least one recess adapted to removably receive a panel for displaying merchandise;

said at least one recess having means for displaying additional merchandise; and a least one panel adapted to fit in said recess, said panel having a front portion adapted for retaining and displaying merchandise, and a rear portion having a graphic.

2. The display of claim 1, wherein the frame is triangular.

3. The display of claim 1, wherein the frame is rotatably mounted.

4. The display of claim 1, wherein the recess has a plurality of receptacles for releasably retaining pegs on which merchandise can be hung and displayed.

5. The display of claim 1, wherein at least one of said faces of said frame has a plurality of recesses.

6. The display of claim 1, wherein the frame comprises cardboard.

* * * * *